US007320628B2

(12) United States Patent
Ando

(10) Patent No.: US 7,320,628 B2
(45) Date of Patent: Jan. 22, 2008

(54) OUTBOARD-TYPE GENERATOR

(75) Inventor: Yoshio Ando, Shizuoka-ken (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 94 days.

(21) Appl. No.: 11/404,203

(22) Filed: Apr. 14, 2006

(65) Prior Publication Data

US 2006/0234566 A1 Oct. 19, 2006

(30) Foreign Application Priority Data

Apr. 14, 2005 (JP) ..... 2005-117057

(51) Int. Cl.
*B63H 21/22* (2006.01)

(52) U.S. Cl. ..... 440/1; 440/2

(58) Field of Classification Search ..... 440/1, 440/2

See application file for complete search history.

(56) References Cited

U.S. PATENT DOCUMENTS 4,836,123 A 6/1989 Grinde et al.
6,149,478 A 11/2000 Lehmann
6,792,897 B2 * 9/2004 Higuchi et al. ..... 123/2
6,825,573 B2 * 11/2004 Suzuki et al. ..... 290/1 A
2002/0053854 A1 * 5/2002 Kanno ..... 310/254
2002/0072282 A1 * 6/2002 Mabru ..... 440/113
2002/0177374 A1 * 11/2002 Mabru ..... 440/113
2003/0159671 A1 * 8/2003 Ikuma et al. ..... 123/184.53

FOREIGN PATENT DOCUMENTS

JP 6-12072 2/1994

* cited by examiner

*Primary Examiner*—Stephen Avila
(74) *Attorney, Agent, or Firm*—Knobbe Martens Olson & Bear LLP

(57) ABSTRACT

An outboard-type generator includes a generator body mountable on a transom of a hull. The outboard-type generator includes an engine and a generator driven by the engine. The generator may be an inverter type generating unit and be connected to an end of a crankshaft of the engine. The generator body has a cooling water inlet to receive cooling water and an exhaust gas outlet. The outboard-type generator is lighter weight and has improved durability, a simplified structure and a higher output in comparison to portable generators.

26 Claims, 9 Drawing Sheets

1

OUTBOARD-TYPE GENERATOR

RELATED APPLICATIONS

The present application is based on and claims priority under 35 U.S.C. § 119(a)-(d) to Japanese Patent Application No. 2005-117057, filed on Apr. 14, 2005, the entire contents of which are hereby expressly incorporated by reference herein.

BACKGROUND OF THE INVENTION

1. Field of the Invention

The present invention relates to an outboard-type generator mountable on a vehicle, and preferably mountable at the rear of a boat hull.

2. Description of the Related Art

In general, two types of generators are used on a boat. A first type, a land generator, utilizes a general purpose engine. The general purpose engine may not be resistant to salt damage, particularly when operated in a sea environment. The second type, a marine generator, may have added features to reliably operate in a sea environment. These features may provide rust prevention, sound proofing, vibration proofing, or the like.

Known outboard engines have a flywheel generator (i.e., a flywheel magneto) electrically connected to the ignition system. The flywheel generator may further serve to charge a battery. However, the flywheel generator of the marine engine has insufficient capacity to generate a large amount of electricity.

In some cases, on board electricity is generated by a belt driven generator driven by the outboard engine in a lateral pulling fashion. See, e.g. Japanese Publication No. 06-12072. However, such systems tend to be large and complex.

SUMMARY OF THE INVENTION

In view of the foregoing, a need exists for an outboard-type generator with improved durability, simplified structure, lighter weight, as well as increased output.

An aspect of the invention is directed to an outboard-type generator comprising a body configured to be mounted on a watercraft and having a cooling water inlet and an exhaust gas outlet, an engine disposed in the body and having a crankshaft, and a generator configured to be driven by the crankshaft so as to generate electricity. The generator can be an inverter type generating unit. The cooling water inlet receives cooling water while the exhaust gas outlet discharges exhaust gas.

Another aspect of the invention is directed to a device configured to be mounted on a transom of a boat. The device comprises a generator configured to generate electricity, a water inlet disposed on the device so that cooling water enters the device in a direction that is substantially perpendicular to a direction of boat travel, wherein the cooling water cools at least the generator, and an engine configured to drive the generator.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled"Detailed Description of the Preferred Embodiments," one will understand how the features of the system and methods provide several advantages over conventional generators.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. However, the invention can be embodied in a multitude of different systems and methods. In this description, reference is made to the drawings wherein like parts are designated with like numerals throughout the description and the drawings.

Figure 1:
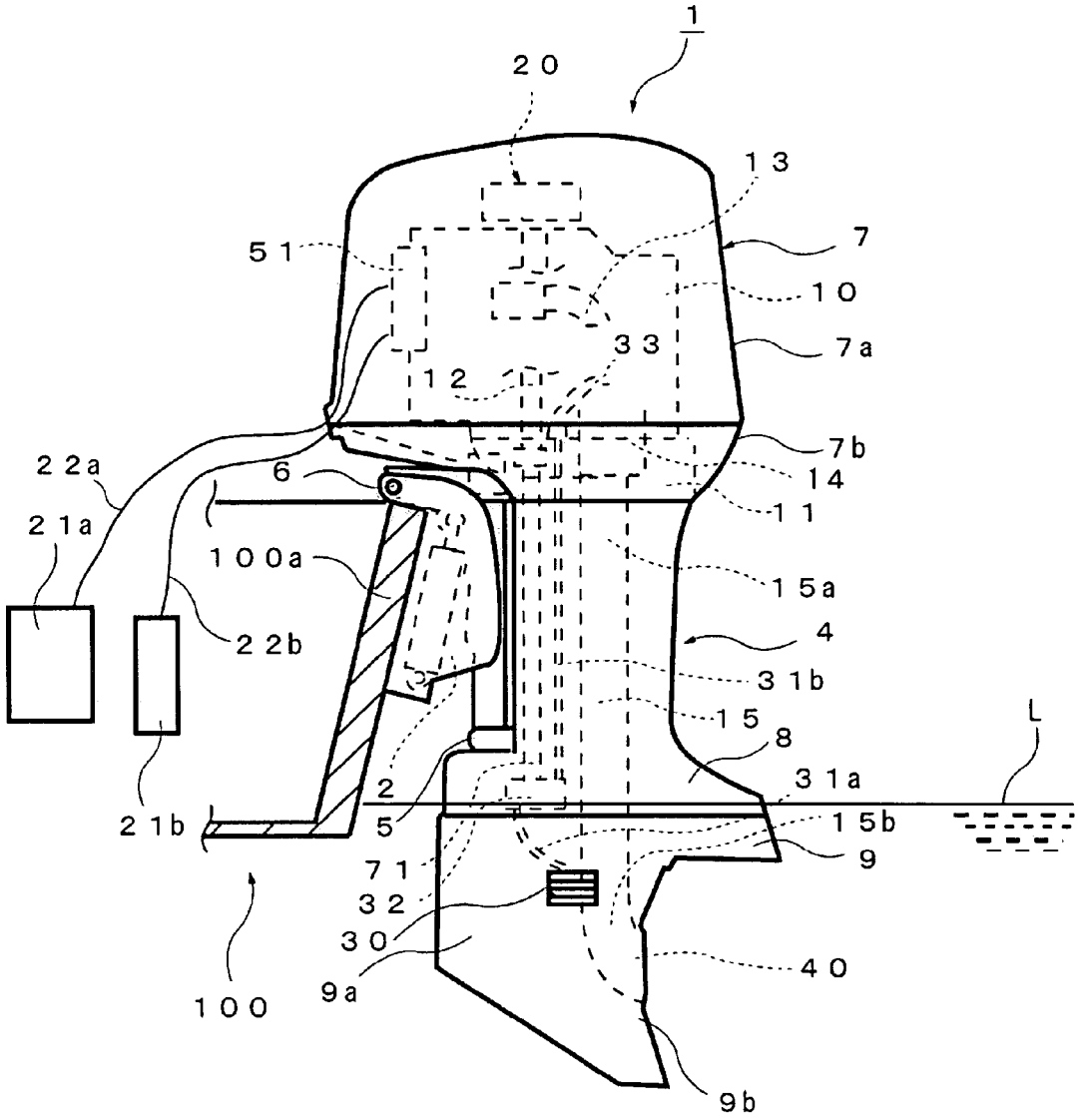
FIG. 1 is a side view of an outboard-type generator configured in accordance with a preferred embodiment of the present invention and mounted on a watercraft.

FIG. 1 is a side view of an outboard-type generator 1 mounted on a watercraft 100 in accordance with a preferred embodiment of the present invention. The outboard-type generator 1 may include a clamping bracket 2, a generator body 4, a swivel bracket 5, and a tilting shaft 6. The clamping bracket 2 is configured to mount to a transom 100*a* or to the rear of the hull of a watercraft 100. The swivel bracket 5 mounts to the clamping bracket 2 and preferably includes upper and lower damper members (not shown). When provided, the upper and lower damper members elastically support the generator body 4. The tilting shaft 6 allows the generator 1 to pivot about the tilting shaft 6.

The generator body 4 includes a cowling 7, an upper case 8, and a lower case 9. The cowling 7 can include a top cowling member 7*a* and a bottom cowling member 7*b*. The cowling 7 houses an engine 10. The engine 10 may be a two-stroke, four-stroke, or other type of engine. An exhaust guide 11 supports the engine 10. The engine 10 includes a crankshaft 12 that may be disposed in generally a vertical direction.

A generator 20 is driven by the engine 10. Electricity generated by the generator 20 can be supplied to a load 21*a* disposed in the watercraft 100 and/or to a battery 21*b*. The load 21*a* can be, for example, one or more pieces of auxiliary equipment and/or a batter which powers auxiliary equipment. The load 21*a* electrically connects to the generator 20 through a power feed line 22*a*. The battery 21*b* also electrically connects to the generator 20 through a power feed line 22*b*.

The generator body 4 further includes a cooling water inlet 30, a pipe 31, and a water pump 32. The pipe 31 may include an upper portion 31*b* and a lower portion 31*a*connected to the water pump 32. The cooling water inlet 30 is preferably submerged below water surface L. For example, the cooling water inlet 30 may extend through a side 9*a* of the lower case 9 and below the water surface L. Advantageously, a cooling water inlet 30 located on the side 9*a* may have a lower resistance to water flow than if the cooing water inlet 30 were located on the front or back regions of the lower case 9. The pipe 31 a connects the water pump 32 to the cooling water inlet 30.

The water pump 32 is driven by the engine 10. For example, a drive shaft 71 connects the water pump 32 to the crankshaft 12 of the engine 10. During operation, the water pump 32 draws cooling water from the cooling water inlet 30 and through the pipe 3 lb. The cooling water may be supplied to the respective cooling systems of the engine 10, the generator 20, and the like. For example, pipe 33 connects the upper portion 31*b* to the engine 10 and generator 20.

The generator body 4 further includes an exhaust pipe 14, an exhaust duct 15, and an exhaust gas outlet 40. The exhaust duct 15 may include an upper part 15*a* and a lower part 15*b*. The exhaust pipe 14 receives exhaust gases from the engine 10 and routes the received gases to the upper part 15*a* of the exhaust duct 15. The upper part 15*a* routes the exhaust gases to the lower part 15*b* of the exhaust duct 15. The lower part 15*b* routes the exhaust gases to the exhaust gas outlet 40. The exhaust gas outlet 40 discharges the exhaust gas. The exhaust gas outlet 40 may be located at the rear 9*b* of the lower case 9 and is preferably submerged below the water surface L so as to attenuate exhaust noise.

Intake pipe 13 is configured to provide air to the engine 10. The intake pipe 13 may be located to one side of the engine 10 with the exhaust pipe 14 being located on the other side of the engine 10. Of course the air intact pipe 13 and the exhaust pipe 14 could be located on the same side of the engine 10. The engine 10 may discharge exhaust gases and cooling water through the same exhaust gas outlet 40. Preferably, the exhaust gas outlet 40 is disposed at the rear of the outboard-type generator 1 where water resistance is low.

Figure 2:
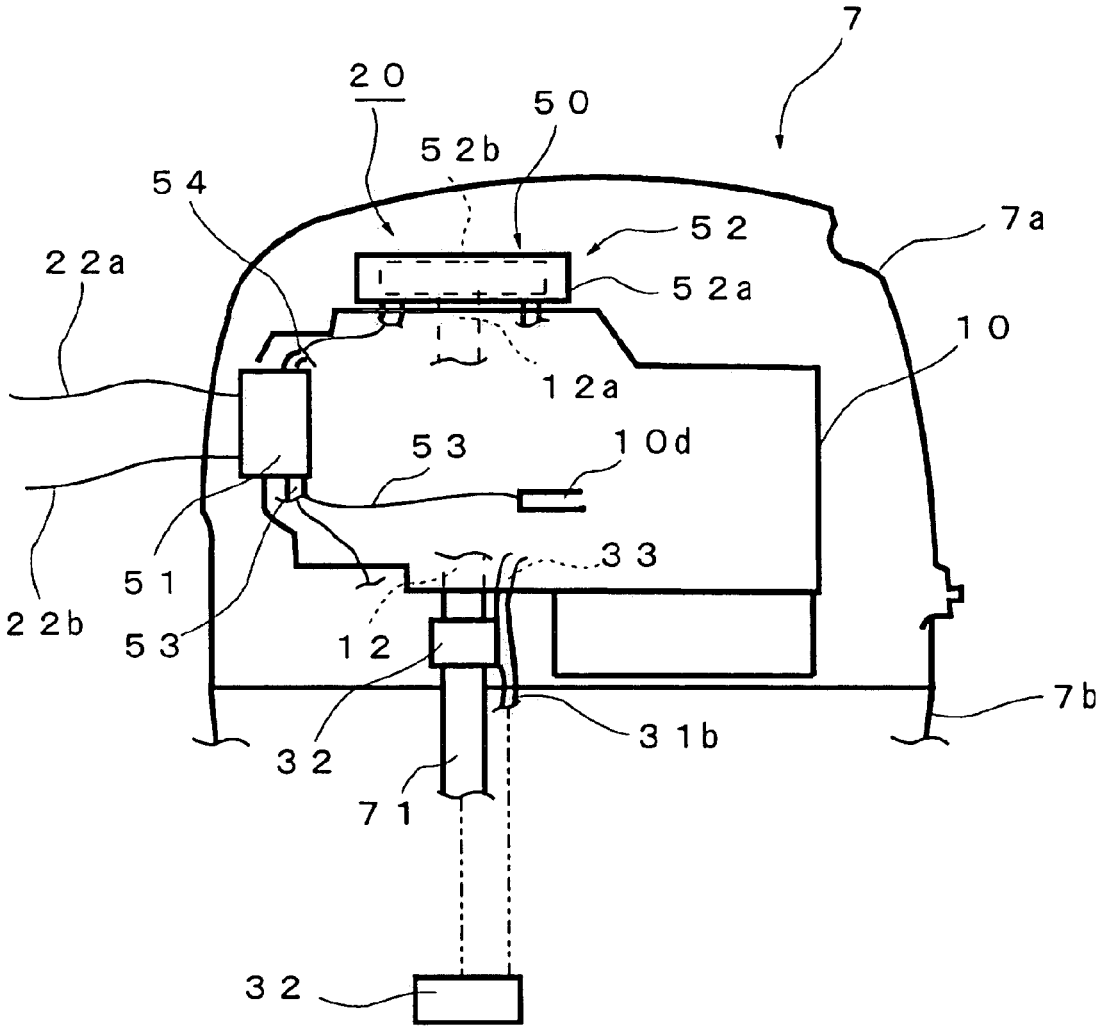
FIG. 2 is a schematic view of an upper portion of the outboard-type generator of FIG. 1.

FIG. 2 is a schematic view of the cowling 7 of the outboard-type generator 1 from FIG. 1. The generator 20 preferably is an inverter type generating unit 50. The inverter type generating unit 50 has an inverter control unit 51 and a multipolar generating body 52. The inverter control unit 51 may be disposed inside the top cowling member 7*a* and on the engine 10. The inverter control unit 51 connects to the power feed lines 22*a*, 22*b*. The inverter control unit 51 may be of a water cooled type that utilizes cooling water to dissipate heat. For a water cooled type unit, a cooling water passage 10*d* routes cooling water between the engine 10 and a supply pipe 53. The pipe 53 routes the cooling water received from the engine 10 to the inverter control unit 51. The supply pipe 53 or another pipe 54 may also route cooling water to the multipolar generating body 52.

Figure 3:
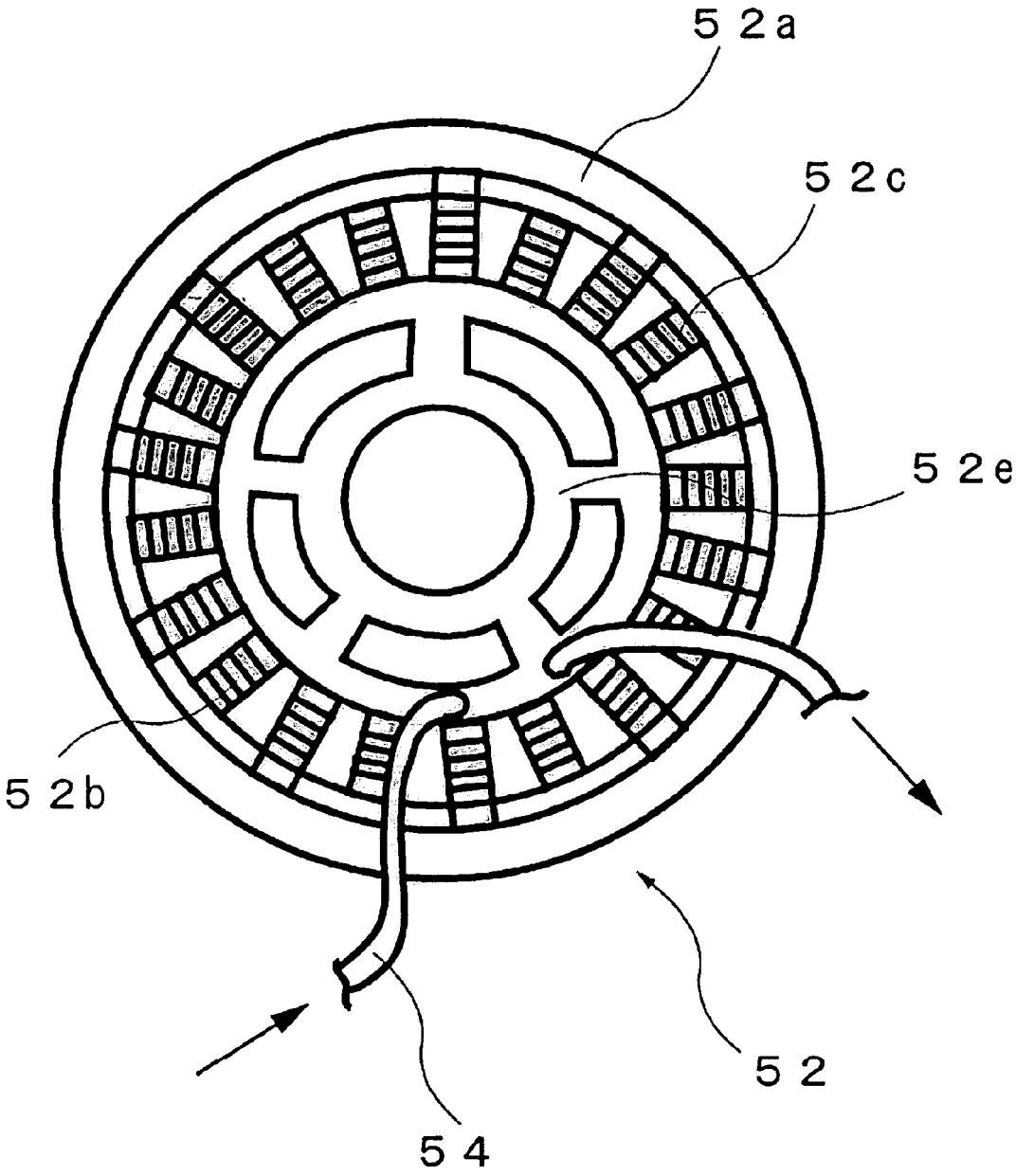
FIG. 3 is a schematic view of a multipolar generating body of FIG. 2.

FIG. 3 is a schematic view of a multipolar generating body 52 from FIG. 2. The multipolar generating body 52 includes a generating rotor 52*a* disposed around a generating coil 52*b*. The generating coil 52*b* may be fixed to the top of the engine 10. The engine 10 rotates the generating rotor 52*a* via the end 12*a* of the crankshaft 12. The generating coil 52*b* generates electricity when rotated. Pipe 54 may route cooling water to the generating coil 52*b* to dissipate heat generated by the rotating coil 52*b*.

The generating rotor 52*a* of the multipolar generating body 52 may serve as a flywheel and/or a magneto when located at the end of the crankshaft 12. However, the engine 10 can include a separate magneto and/or flywheel in some embodiments. The inverter type generating unit 50 has a simplified structure, is lightweight, and outputs more current than known flywheel generators. Water cooling the core 52*e* of the generating coil 52*b* cools the coil body of the generator 20 and improves durability.

Figure 4:
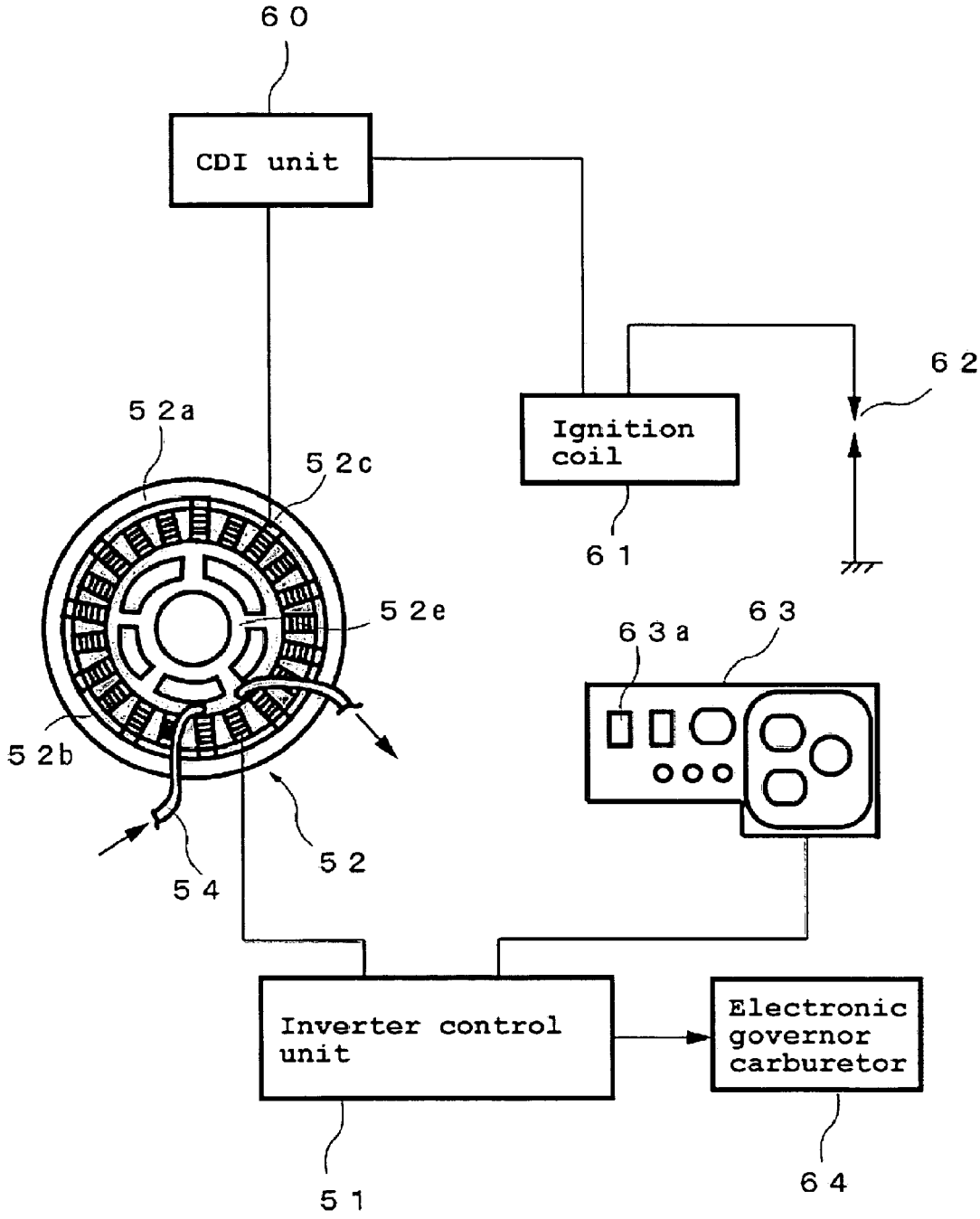
FIG. 4 is a circuit diagram of the outboard-type generator of FIG. 1.

FIG. 4 is a circuit diagram of the outboard-type generator 1 from FIG. 1. The outboard-type generator 1 includes an inverter control unit 51 and the multipolar generating body 52 described with reference to FIG. 3. The multipolar generating body 52 includes a pickup coil 52*c* for an ignition system. The pickup coil 52*c* is connected to a CDI unit 60 for controlling the engine 10. The CDI unit 60 controls the ignition timing of the engine 10. The CDI unit 60 signals the ignition coil 61 to apply a high voltage to spark an ignition plug 62.

The inverter control unit 51 may be connected to a switchboard 63. The switchboard 63 may be disposed at a convenient and accessible location inside the watercraft 100. The switchboard 63 may include an engine-starting key switch 63*a*. The engine-starting key switch 63*a* may provide remote control of the outboard-type generator 1.

The load 21*a* illustrated in FIG. 1 and powered by the outboard-type generator 1 may be application equipment. For example, the outboard-type generator 1 can power a marine air conditioner, electrical equipment (microwave ovens, water heaters, refrigerators, and the like), and fishing equipment (motor rollers, fishing lights, and the like). The outboard-type generator 1 may provide voltages of 100V, 120V, 230V, or a battery voltage (12V or 24V) depending on the selected load 21*a*. The inverter control unit 51 may be automatically set so that the voltage and current generated by the outboard-type generator 1 corresponds to the load 21*a*.

The fuel feed system of the engine 10 may utilize an electronic governor carburetor 64.

Figure 5:
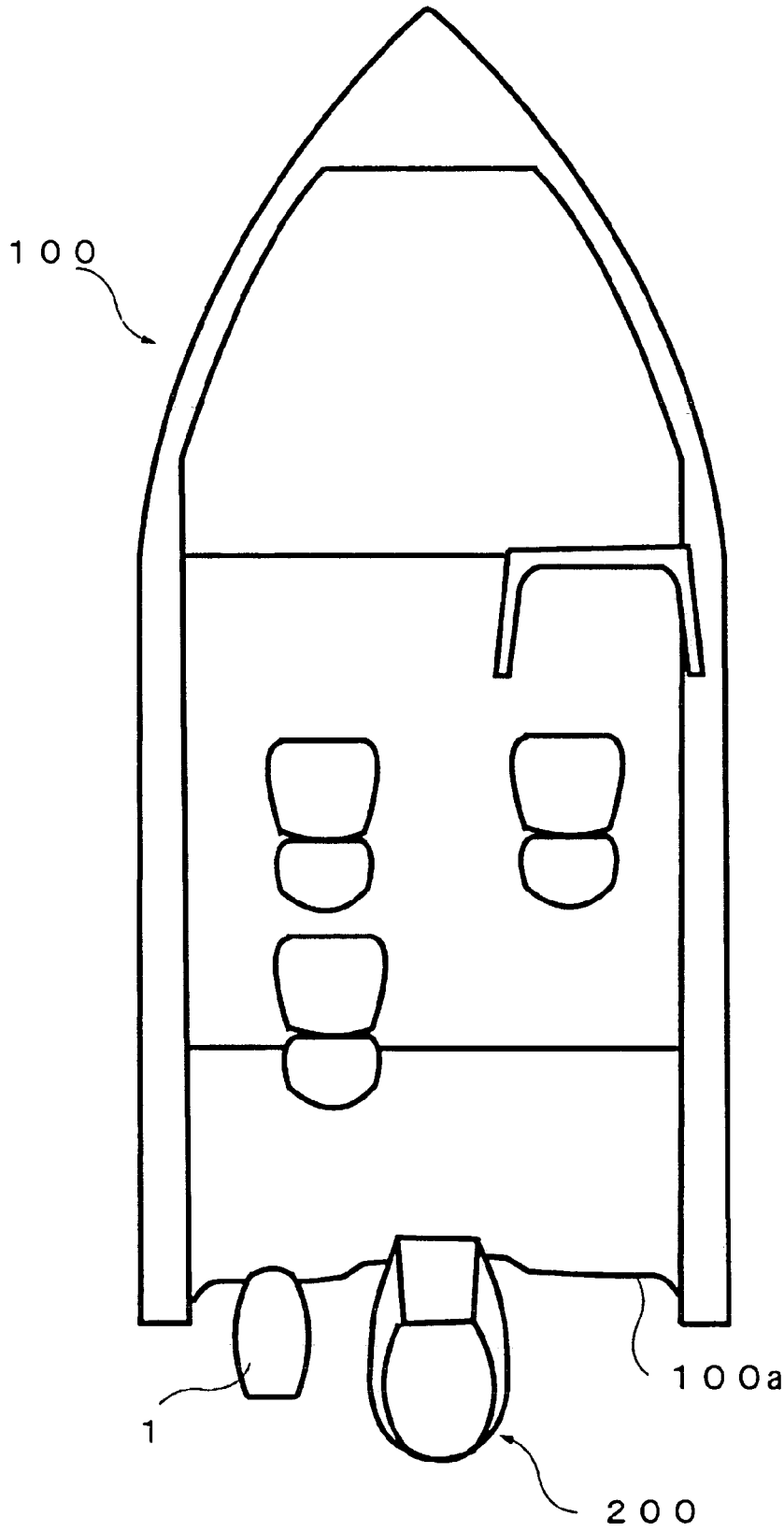
FIG. 5 is a plan view showing the outboard-type generator of FIG. 1 mounted on a watercraft and to a side of an outboard motor.
Figure 6:
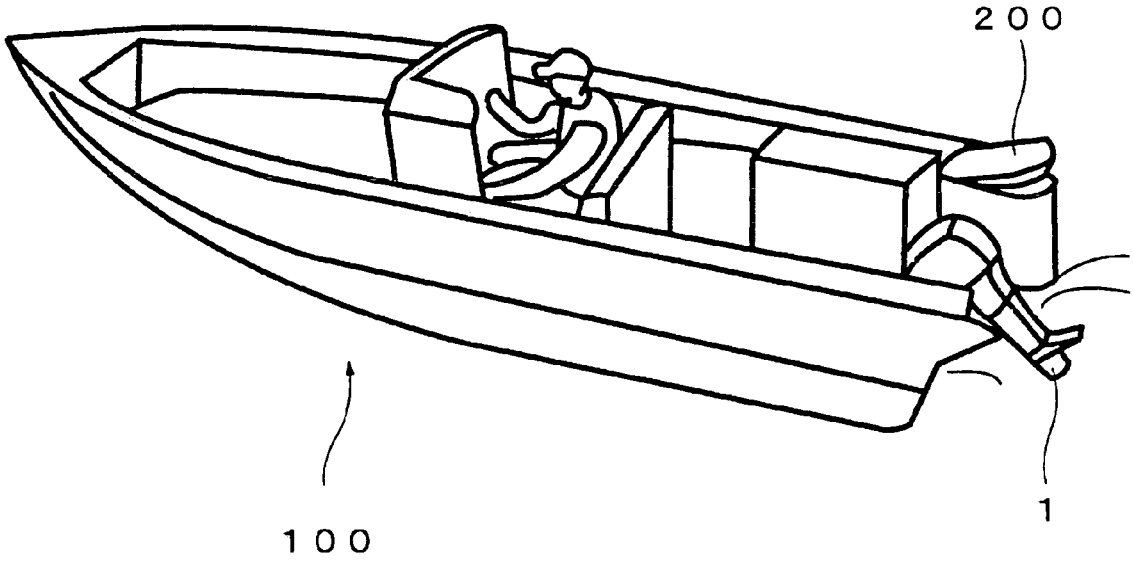
FIG. 6 is a side view showing the outboard-type generator of FIG. 5 in a tilted-up position.

FIG. 5 is a plan view showing the outboard-type generator 1 mounted on a watercraft 100. An outboard motor 200 and the outboard-type generator 1 are mounted side by side to a transom plate 100*a* of the watercraft 100. The outboard-type generator 1 may have a shape that is similar to the shape of the outboard motor 200. FIG. 6 is a side view showing the outboard-type generator 1 from FIG. 5 in a tilted-up position.

The outboard-type generator 1 has a tilt-up mechanism. When the watercraft 100 is propelled by the main outboard motor 200, the outboard-type generator 1 is in a tilted-up position. When the watercraft 100 is moving and the outboard-type generator 1 is in the tilted-up position, the water resistance caused by the outboard-type generator 1 is reduced as compared to if the outboard-type generator 1 were in the down position. The outboard-type generator 1 still generates power when in the tilted-up position and the watercraft 100 is moving. The durability of the outboard-type generator 1 is improved since cooling water cools the engine 10 and generator 20 even when the outboard-type generator 1 is in the tilted-up position.

The outboard-type generator 1 is preferably mounted by the side of the main outboard motor 200 as illustrated in FIG. 5. The side of the outboard motor 200 is more convenient than other locations on the watercraft 100. Locating the outboard-type generator 1 close to the outside or perimeter of the watercraft 100 simplifies installation by not requiring additional hoses for routing cooling water to the outboard-type generator 1.

Figure 7:
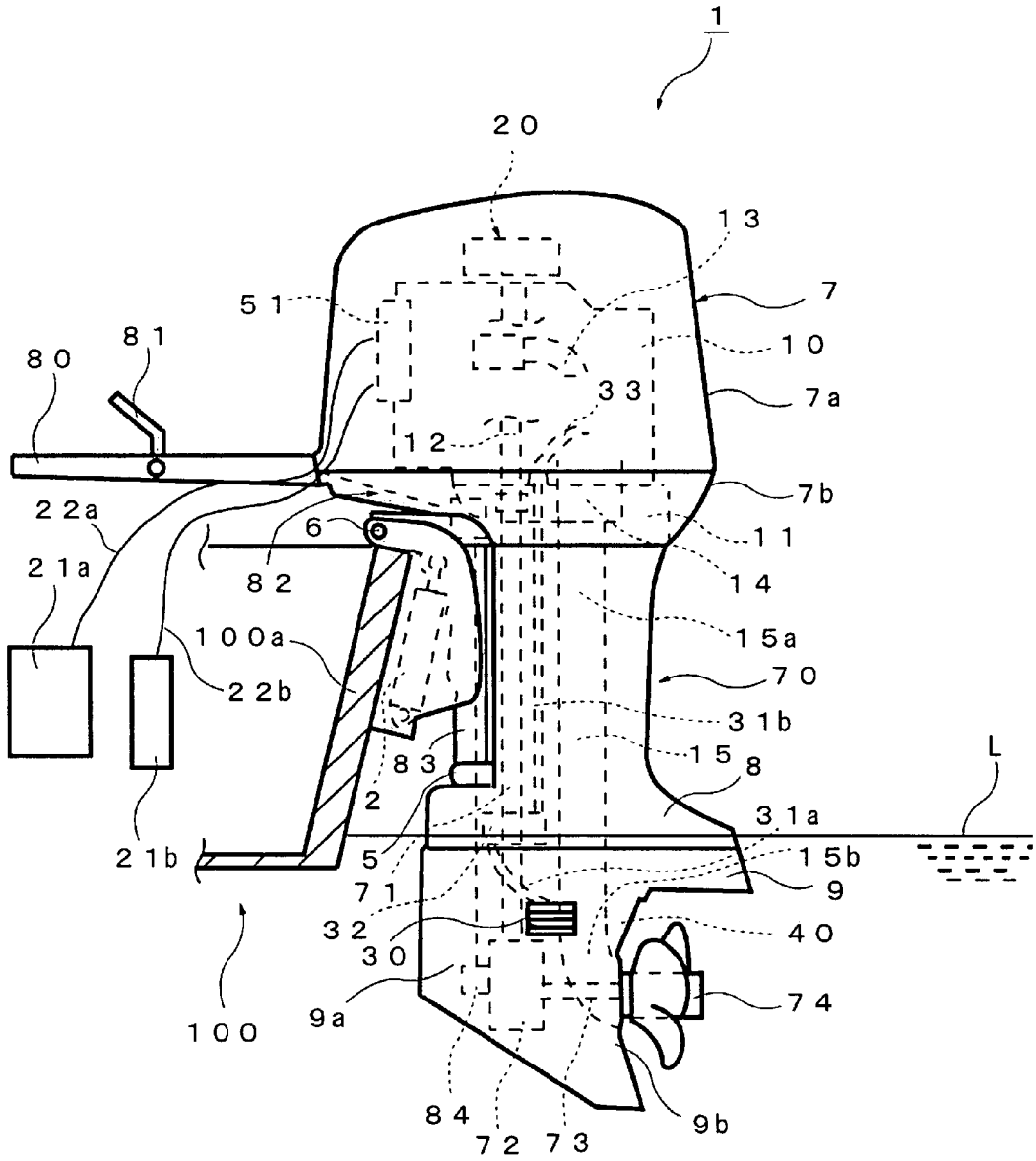
FIG. 7 is a schematic view of another outboard-type generator configured in accordance with another preferred embodiment of the present invention.

FIG. 7 is a schematic view of another embodiment of an outboard-type generator 1 shown mounted on a watercraft 100. The embodiment illustrated in FIG. 7 is similar to the embodiment illustrated in FIG. 1 except that the embodiment illustrated in FIG. 7 includes a propulsion device 70. The propulsion device 70 is driven by the engine 10 and provides thrust for the watercraft 100. The propulsion device 70 includes a drive shaft 71, a propeller shaft 73, and a propeller 74. The propulsion device preferably also includes an advancing-and-reversing switching mechanism 72.

The drive shaft 71 passes through the upper case 8 generally in the vertical direction. The upper end of the drive shaft 71 connects to the crankshaft 12 of the engine 10. In the illustrated embodiment, the lower end of the drive shaft 71 connects to the advancing-and-reversing switching mechanism 72 generally housed in the lower case 9. The propeller shaft 73 extends from the advancing-and-reversing switching mechanism 72 in a horizontal direction. The propeller 74 is mounted to the aft end of the propeller shaft 73.

The outboard-type generator 1 may include an operating handle 80. The operating handle 80 may include a shift switching lever 81. A user may select, for example, advance, neutral, or reverse by changing the position of the shift switching lever 81. The shift switching lever 81 is coupled to a shift mechanism 82. Movement of the shift mechanism 82 moves a shifting rod 83 that is connected to a control section 84. The control section 84 actuates the advancing-and-reversing switching mechanism 72 in a manner well known in the art.

Figure 8:
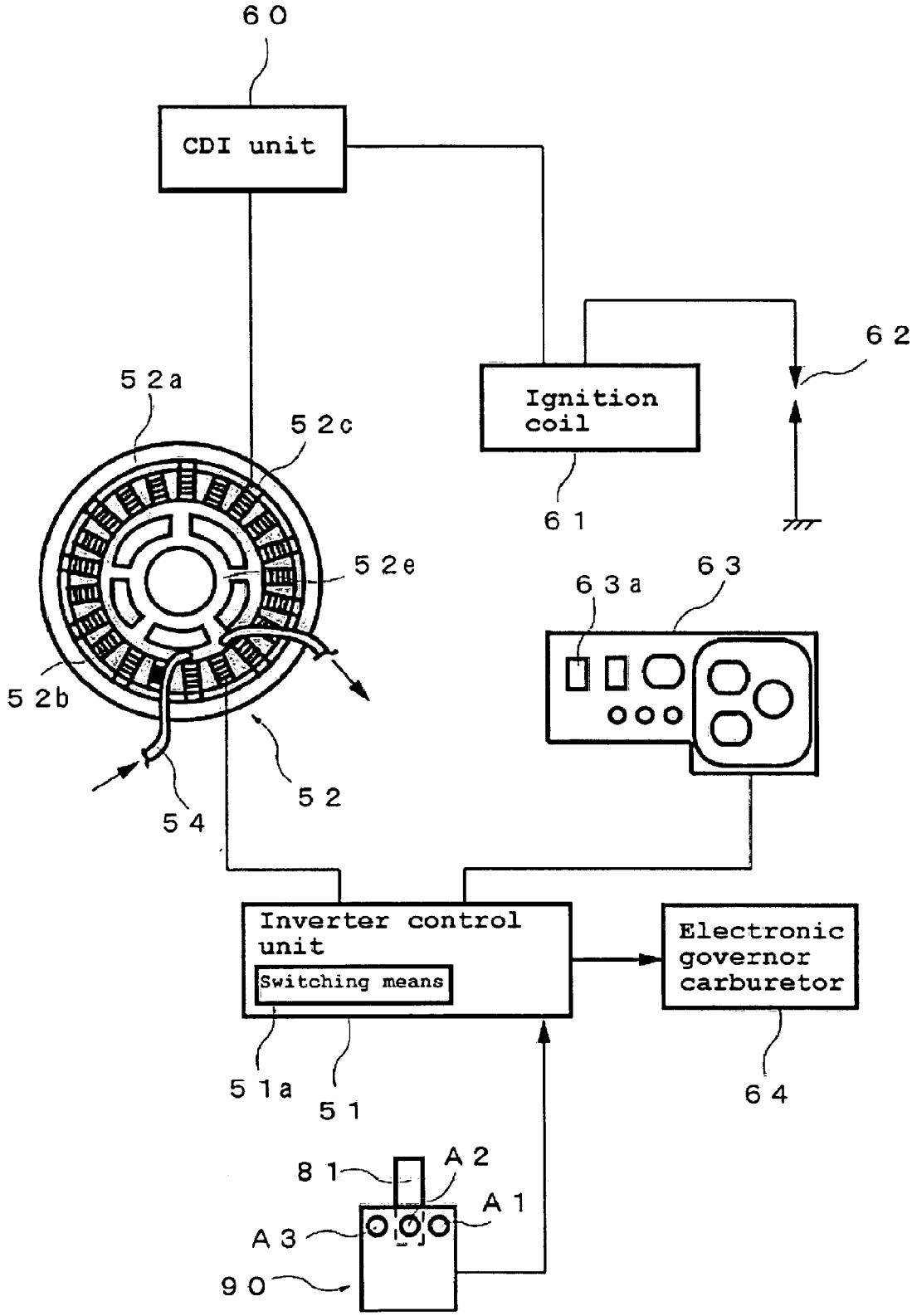
FIG. 8 is a circuit diagram of the outboard-type generator of FIG. 7.

FIG. 8 is a circuit diagram of the outboard-type generator 1 from FIG. 7. The circuit diagram of the outboard-type generator 1 is similar to the circuit diagram illustrated in FIG. 4 except that the embodiment illustrated in FIG. 8 includes a shift-detector 90 and the inverter control unit 51 includes a switching means 51*a*.

The shift-position detector 90 can be disposed in the operating handle 80. The shift-position detector means 90 performs the function of detecting the user-selected shift position. For example, the shift-position detector 90 may detect advancing position Al, neutral position A2, and reversing position A3 of the shift switching lever 81. The detector 90 can alternatively interact with the switching mechanism 72 or another part of the switching mechanism between the shift switching lever 81 and the switching mechanism 72 with the A signal representing the shift position preferably is sent to the switching means 51*a* of the inverter control unit 51. The switching means 51*a* performs the function of changing the operational state of the outboard-type generator 1 between the generator 20 generating electricity and the propulsion device 70 propelling the watercraft 100. The switching means 51*a* cuts off or reduces the flow of electricity to at least the load 21*a* of the generator 20 based on the detected shift position (advancing position Al or reversing position A3). For example, in the illustrated embodiment, the outboard-type generator 1 generates power when in the neutral position A2 based on the detected information. When, in the advancing position Al or the reversing position A3, the outboard-type generator 1 does not generate power. Instead, the outboard-type generator 1 operates like a propulsion device 70 to propel the watercraft 100. For example, when the flow of electricity to the load 21 from the generator 20 is cut off or reduced based on the detected shift position, the outboard-type generator 1 switches to operating primary as a propulsion device rather than a generator. When operating in this mode, the outboard-type generator 1 can function as an auxiliary propulsion device 70 to supplement the propulsion provided by outboard motor 200, or to independently propel the watercraft.

In some embodiments the power generating function is essentially turned off when the shifting mechanism 72 operates under a drive condition (e.g., under either a forward or reverse drive condition). In other embodiments, the power generating function may be maintained, at least to some degree, when the shifting mechanism 72 occupies the neutral portion and/or one of the drive portions (e.g., a forward drive position). Under all drive conditions, however, the generator 20 preferably operates as a magneto to power at least the ignition system of the engine (unless a separate magneto is provided).

Although the switching means 51*a* relies upon the position of the shift switching lever 81 to switch between the generating and propulsion modes, a separate change-over switch may be employed. For example, the outboard-type generator 1 could switch between modes in response to a user turning or changing the position of the separate change-over switch.

Figure 9:
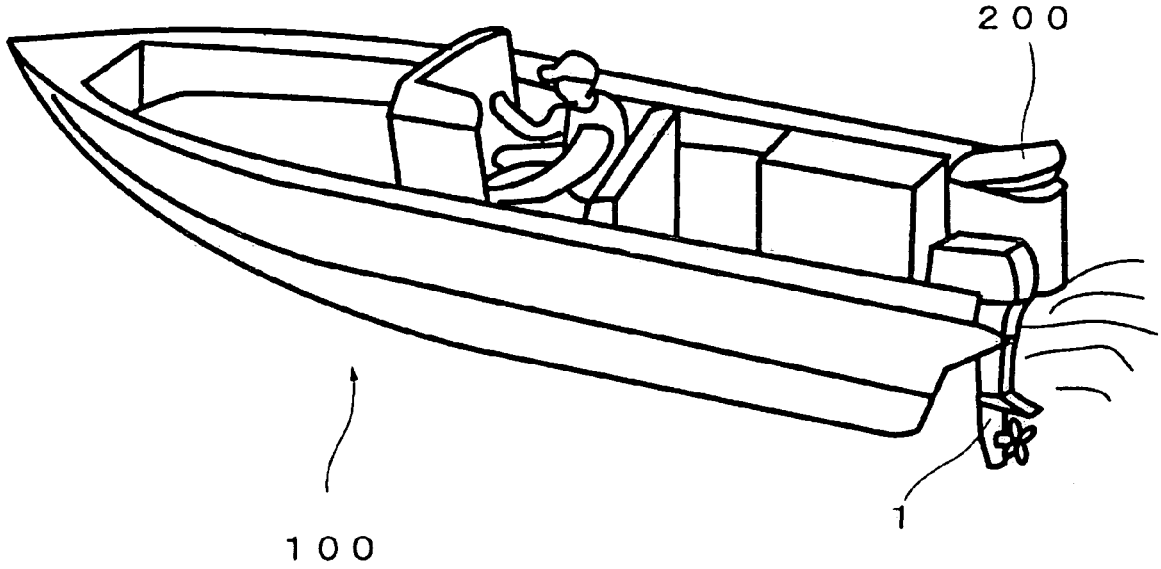
FIG. 9 is a side view showing the outboard-type generator of FIG. 7 mounted on the watercraft and to a side of an outboard motor.

FIG. 9 is a side view showing the outboard-type generator 1 of FIG. 7 mounted on the watercraft 100 and to a side of an outboard motor 200. The main outboard motor 200 and the auxiliary outboard-type generator 1 are mounted to the transom 100*a* of the watercraft 100. When the watercraft 100 is propelled by the main outboard motor 200, the auxiliary outboard-type generator 1 is preferably in a tilted-up position. When the watercraft 100 is traveling at a controlled slow speed, for example, when fishing, the main outboard motor 200 may be turned off. When the main outboard motor 200 is turned off, the auxiliary outboard-type generator 1 may be tilted to a down position so as to propel the watercraft 100 at a controlled slow speed. As such, a user may select a faster mode of travel using the main outboard motor 200 or a slower mode of travel using the auxiliary outboard-type generator 1.

The embodiments have a simplified structure that includes an inverter type generating unit preferably located at the end of a crankshaft. The structure is lighter in weight and provides higher power output than known flywheel generators. In addition, the durability of the outboard-type generator 1 is improved by using cooling water to cool the engine 10 and the generator 20. Further, the embodiments do not require additional connecting hoses for cooling water, exhaust gas, and the like. Even when the watercraft is moving, cooling water may be cycled through the outboard-type generator 1 and exhaust gas may be discharge from the generator so as to allow the generator outside the watercraft to produce electricity even when the watercraft is moving.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An outboard-type generator comprising:

a body configured to be mounted on a watercraft and having a cooling water inlet and an exhaust gas outlet;

an engine disposed in the body and having a crankshaft;

a propulsion device having at least one rotatable blade; and an inverter-type generator driven by the crankshaft to generate electricity.

2. The outboard-type generator as in claim 1, wherein the propulsion device is driven by the engine.

3. The outboard-type generator as in claim 1 additionally comprising a switching mechanism to varying the loading on the engine to drive the generator and the propulsion device.

4. The outboard-type generator as in claim 3, wherein the switching mechanism changes at least between a first operating condition in which the loading on the engine is primarily associated with driving the generator and a second condition in which the loading on the engine is primarily associated withdriving the propulsion device.

5. The outboard-type generator as in claim 4, wherein the switching mechanism includes a transmission selectively coupling the engine with the propulsion device and a shift-position detector for detecting whether the transmission is engaged to couple together the engine and the propulsion device, and wherein the switching mechanism is configured to varying the loading on the engine depending upon whether the transmission is engaged.

6. An outboard-type generator comprising a housing having a lower unit submergible in a body of water, a tilt-up mechanism connected to and supporting the housing, the tilt-up mechanism being configured to mount on a transom of a watercraft, a generator configured to generate electricity and disposed within the housing, a water inlet disposed on the housing lower unit so that cooling water enters the housing, the tilt-up mechanism being moveable to raise and lower at least the lower unit to vary a submerged depth of the water inlet, a cooling system connected to the water inlet and being configured to cool the generator with cooling water, a propeller, and an engine driving the generator and being disposed within the housing.

7. The outboard-type generator as in claim 6, further comprising a transmission, the transmission being movable between a plurality of shift positions to selectively couple together the engine and the propeller.

8. The outboard-type generator as in claim 7, further comprising a switch configured to change the engine between driving the generator and the propeller.

9. The outboard-type generator as in claim 7, further comprising a shift-position detector to determine the shift position associated with the transmission, wherein the switch performs the change-over between driving the generator and the propeller based on a detected shift position.

10. An outboard-type generator comprising a housing having a lower unit submergible in a body of water, a tilt-up mechanism connected to and supporting the housing, the tilt-up mechanism being configured to mount on a transom of a watercraft, a generator configured to generate electricity and disposed within the housing, a water inlet disposed on the housing lower unit so that cooling water enters the housing, the tilt-up mechanism being moveable to raise and lower at least the lower unit to vary a submerged depth of the water inlet, a cooling system connected to the water inlet and being configured to cool the generator with cooling water, an engine driving the generator and being disposed within the housing, and a propeller and a transmission, the transmission being movable between a plurality of shift positions to selectively couple together the engine and the propeller.

11. The outboard-type generator as in claim 10, further comprising a coolant pipe, the coolant pipe being configured to route cooling water to the engine.

12. The outboard-type generator as in claim 10, further comprising an exhaust pipe, the exhaust pipe being configured to route exhaust gas from the engine.

13. The outboard-type generator as in claim 12, wherein the exhaust pipe is located within the housing.

14. The outboard-type generator as in claim 12, wherein the exhaust pipe is configured to route coolant water from the generator.

15. The outboard-type generator as in claim 10, wherein the device is configured to be mounted on the boat.

16. The outboard-type generator as in claim 10, wherein the device is configured to be mounted on a transom of the boat.

17. The outboard-type generator as in claim 10, further comprising an exhaust gas outlet.

18. The outboard-type generator as in claim 17, wherein the water inlet and the exhaust gas outlet are disposed so as to be submerged below water level when the boat is traveling on the water.

19. The outboard-type generator as in claim 10 additionally comprising a bracket mountable to the transom for supporting the housing.

20. The outboard-type generator as in claim 19, wherein the bracket includes an aperture for receiving a shaft, the housing rotating about the shaft when raising and lowering the lower unit.

21. The outboard-type generator as in claim 10, further comprising a bracket swiveling the housing relative to the transom.

22. An outboard-type generator comprising:

a body configured to be mounted on a watercraft and having a cooling water inlet and an exhaust gas outlet;

an engine disposed in the body and having a crankshaft;

an inverter-type generator driven by the crankshaft to generate electricity;

a propulsion device driven by the engine; and a switching mechanism to varying the loading on the engine to drive the generator and the propulsion device.

23. An outboard-type generator comprising:

a body configured to be mounted on a watercraft and having a cooling water inlet and an exhaust gas outlet;

an engine disposed in the body and having a crankshaft;

an inverter-type generator driven by the crankshaft to generate electricity;

a propulsion device driven by the engine; and a switching mechanism to varying the loading on the engine to drive the generator and the propulsion device, wherein the switching mechanism changes at least between a first operating condition in which the loading on the engine is primarily associated with driving the generator and a second condition in which the loading on the engine is primarily associated with driving the propulsion device.

24. An outboard-type generator comprising:

a body configured to be mounted on a watercraft and having a cooling water inlet and an exhaust gas outlet;

an engine disposed in the body and having a crankshaft;

an inverter-type generator driven by the crankshaft to generate electricity;

a propulsion device driven by the engine; and a switching mechanism to varying the loading on the engine to drive the generator and the propulsion device, wherein the switching mechanism changes at least between a first operating condition in which the loading on the engine is primarily associated with driving the generator and a second condition in which the loading on the engine is primarily associated with driving the propulsion device; and wherein the switching mechanism includes a transmission selectively coupling the engine with the propulsion device and a shift-position detector for detecting whether the transmission is engaged to couple together the engine and the propulsion device, and wherein the switching mechanism is configured to varying the loading on the engine depending upon whether the transmission is engaged.

25. An outboard-type generator comprising a housing having a lower unit submergible in a body of water, a tilt-up mechanism connected to and supporting the housing, the tilt-up mechanism being configured to mount on a transom of a watercraft, a generator configured to generate electricity and disposed within the housing, a water inlet disposed on the housing lower unit so that cooling water enters the housing, the tilt-up mechanism being moveable to raise and lower at least the lower unit to vary a submerged depth of the water inlet, a cooling system connected to the water inlet and being configured to cool the generator with cooling water, an engine driving the generator and being disposed within the housing, a propeller and a transmission, the transmission being movable between a plurality of shift positions to selectively couple together the engine and the propeller, and a switch configured to change the engine between driving the generator and the propeller.

26. An outboard-type generator comprising a housing having a lower unit submergible in a body of water, a tilt-up mechanism connected to and supporting the housing, the tilt-up mechanism being configured to mount on a transom of a watercraft, a generator configured to generate electricity and disposed within the housing, a water inlet disposed on the housing lower unit so that cooling water enters the housing, the tilt-up mechanism being moveable to raise and lower at least the lower unit to vary a submerged depth of the water inlet, a cooling system connected to the water inlet and being configured to cool the generator with cooling water, an engine driving the generator and being disposed within the housing, a propeller and a transmission, the transmission being movable between a plurality of shift positions to selectively couple together the engine and the propeller, and a shift-position detector to determine the shift position associated with the transmission, wherein the switch performs the change-over between driving the generator and the propeller based on a detected shift position.

* * * * *